United States Patent [19]

Kuijpers et al.

[11] Patent Number: 4,848,098

[45] Date of Patent: Jul. 18, 1989

[54] REFRIGERATING SYSTEM

[75] Inventors: Lambert J. M. Kuijpers; Johannes A. De Wit, both of Eindhoven, Netherlands

[73] Assignee: U.S. Philips Corp., New York, N.Y.

[21] Appl. No.: 211,540

[22] Filed: Jun. 27, 1988

[30] Foreign Application Priority Data

Jun. 30, 1987 [NL] Netherlands ..... 8701527

[51] Int. Cl.[4] ..... F25B 41/04

[52] U.S. Cl. ..... 62/211; 62/511

[58] Field of Search ..... 62/209, 211, 223, 511, 62/204, 205, 206, 208, 210, 212, 222, 224, 225, DIG. 17

[56] References Cited

U.S. PATENT DOCUMENTS 1,782,687 11/1930 Hoffman ..... 62/225 X
3,367,130 2/1968 Owens ..... 62/222
4,507,934 4/1985 Tanaka et al. ..... 62/DIG. 17

*Primary Examiner*—Harry B. Tanner
*Attorney, Agent, or Firm*—Ernestine C. Bartlett

[57] ABSTRACT

In a refrigerating system comprising a reciprocating compressor (1), a condensor (2), an expansion means (3), an evaporator (5), a temperature-sensitive control element (6) for on/off control of the compressor, a refrigerant-pressure-dependent valve (4) is used for shutting off the flow of refrigerant between the condensor and the evaporator when the compressor is off and for allowing the flow of refrigerant between the condensor and the evaporator when the compressor is on. The valve (4) comprises a pressure-sensitive means (9) which is movable under the influence of the condensor outlet pressure which prevails at one side of the pressure-sensitive means, while the pressure at the other side of the pressure-sensitive means depends on the saturation pressure of a liquid in a circuit which includes a bulb (15) arranged at a location where it is exposed to the influence of ambient temperature.

8 Claims, 1 Drawing Sheet

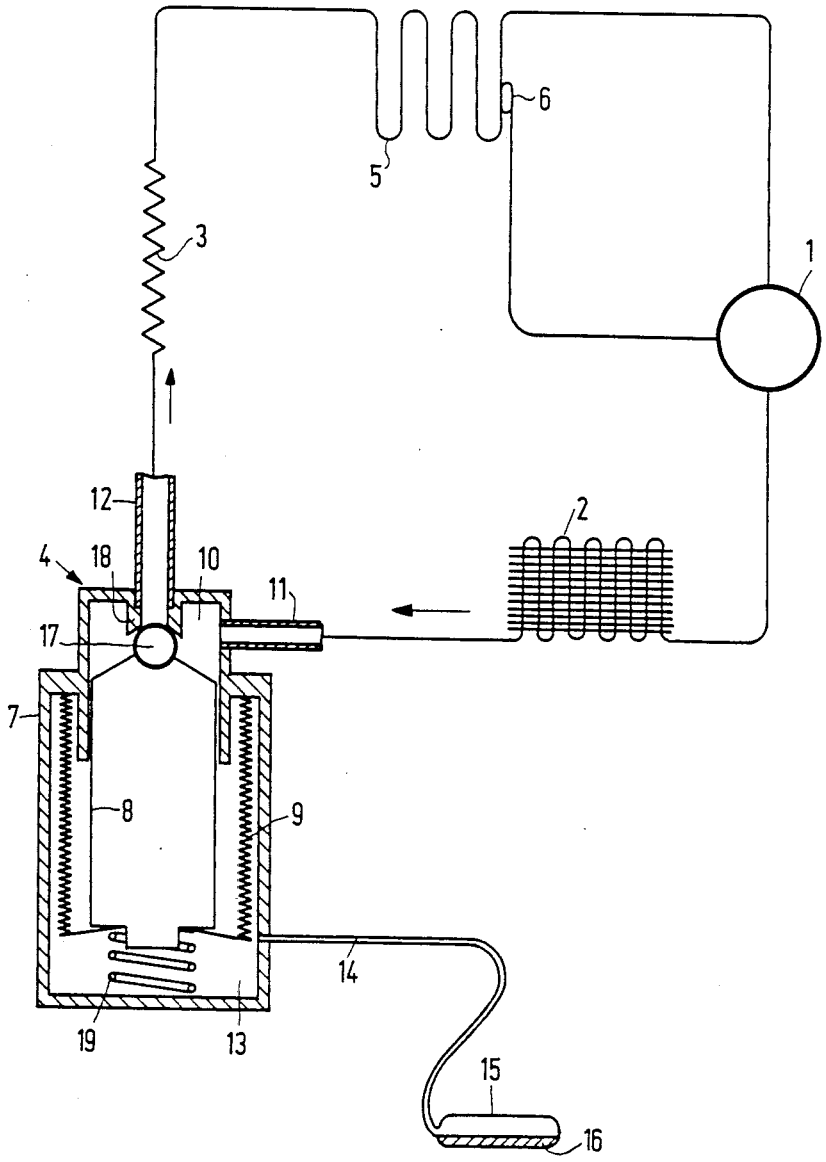
1
2
3
4
5
6
7
8
9
10
11
12
13
14
15
16
17
18
19

REFRIGERATING SYSTEM

FIELD OF THE INVENTION

The invention relates to a refrigerating system comprising a reciprocating compressor, a condenser, an expansion means, an evaporator, a temperature-sensitive control element for on/off control of the compressor, and a refrigerant-pressure-dependent valve for shutting off the flow of refrigerant between the condensor and the evaporator when the compressor is turned off and for allowing the flow of refrigerant between the condenser and the evaporator when the compressor is turned on, which valve comprises a pressure-sensitive means comprising a shut-off means which is movable under the influence of the condenser outlet pressure which prevails at one side of the pressure-sensitive means.

BACKGROUND OF THE INVENTION

Such a refrigerating system is known from U.S. Pat. No. 4,267,702 entitled "Refrigeration System With Refrigerant Flow Controlling Valve" and issued May 19, 1981.

It is known that if during the off-periods of the compressor the condenser is not shut off from the evaporator, which gives rise to pressure equalization between the condenser and the evaporator, this produces energy losses in the refrigerating system. These losses arise because the pressurized liquid from the condenser expands via the expansion means, the gas thus formed being condensed in the evaporator, resulting in a thermal input in the evaporator.

In accordance with U.S. Pat. No. 4,267,702 a valve is arranged between the condenser and the evaporator and comprises a pressure-sensitive diaphragm, the pressure at one side of the diaphragm being equal to the condenser pressure and the pressure at the other side being the condenser pressure reduced by means of a restriction. The diaphragm is responsive to the pressure difference to open and close the passage between the condenser and the evaporator when the compressor is turned on and off respectively. During the on-period of the compressor the chambers at opposite sides of the diaphragm will be entirely filled with liquid. After the compressor has been turned off a pressure difference arises across the diaphragm, which difference depends on the size (passage) of the restriction and on the sensitivity of the diaphragm. A requirement for the correct operation of this system is that the restriction should be very small (of the order of 0.01 mm). However, the disadvantage of such a small passage is that the likelihood of soiling and hence clogging is substantial. If a larger passage is selected for the restriction the diaphragm construction will have to be very sensitive, large and hence expensive.

It is also known to arrange an electromagnetic valve between the condenser and the evaporator in such a refrigerating system, which valve is responsive to the compressor being turned on and off. Such a valve consumes additional power. This is advantageous only in large refrigerating systems because the gain in power as a result of shutting off the refrigerant flow between the condenser and the evaporator during the off period of the compressor is then comparatively high. In a small refrigerating system, such as a domestic refrigerator, an electromagnetic valve consumes so much power that this gain in power is substantially cancelled.

Further, U.S. Pat. No. 2,331,264, entitled "Refrigeration System" and issued Oct. 5, 1943, describes a refrigerating system comprising a rotary compressor and a valve arranged between the capillary and the evaporator. During the on-period of the compressor one side of the diaphragm of the valve is at the evaporator inlet pressure and the other side is at the evaporator outlet pressure via a capillary line. After the compressor has been turned off the evaporator outlet line is shut off by a non-return valve and the capillary line and hence said other side of the diaphragm will be at the higher condenser inlet pressure, causing the valve to close the passage to the evaporator. This system employs a rotary compressor and therefore an additional non-return valve is needed in order to prevent the evaporator pressure from becoming too high. Moreover, it is common practice to arrange a bypass comprising an electromagnetic valve across the rotary compressor between the condenser and the capillary line. If such a system utilizes a reciprocating compressor such a bypass comprising an electronagnetic valve is indispensable.

SUMMARY OF THE INVENTION

An object of the invention is to improve a refrigerating system, comprising a reciprocating compressor, a condenser, an expansion means, an evaporator, a temperature sensitive control element for on/off control of the compressor, and a refrigerant-pressure-dependent valve for shutting off the flow of refrigerant between the condenser and the evaporator when the compressor is turned off and for allowing the flow of refrigerant between the condenser and evaporator when the compressor is turned on, in such a way that a reliable, simple and cheap system is obtained which provides said power gain and which also compensates for ambient-temperature effects.

To this end the refrigerating system in accordance with the invention is characterized in that it comprises a bulb, which is arranged at a location which is exposed to ambient temperature variations, which contains a liquid whose saturation pressure depends on the ambient temperature, and which is connected to the other side of the pressure-sensitive means by a capillary line.

The system of forces acting on the pressure-sensitive means and hence on the shutter as a result of the obtaining pressures should be such that after a decrease in condenser pressure as a result of the compressor being turned off the shut-off means as rapidly as possible shuts off the line to the evaporator. This can be achieved by a suitable choice of the refrigerant in the refrigerating circuit in relation to the liquid in the bulb circuit.

A rapid shut-off can also be obtained in accordance with a preferred embodiment in which the valve comprises a spring whose spring bias exerts a force on the pressure-sensitive element to assist the action of the saturation pressure on the pressure sensitive means. Depending on the selected refrigerant and the liquid in the bulb circuit this bias may be positive, to amplify the effect of the saturation pressure or negative to attenuate the effect of the saturation pressure.

BRIEF DESCRIPTION OF THE DRAWINGS

The FIGURE is a diagrammatic drawing of a refrigerating system in accordance with the invention in which the valve is shown to an enlarged scale.

DETAILED DESCRIPTION OF THE PREFERRED EMBODIMENTS

The refrigerating circuit comprises a compressor 1, whose piston is reciprocated by an electric motor, a condenser 2, an expansion means in the form of a capillary 3, a valve 4, an evaporator 5, and a temperature sensitive control element 6 for on/off control of the compressor.

The valve 4 is provided with a housing 7 in which a plunger 8 is movable. In the housing the plunger is suspended from a pressure-sensitive element 9, for example bellows or a diaphragm. The bellows 9 divide the space inside the housing 7 into two sections, namely a first chamber 10, in which both an inlet line 11 from the condenser 2 and an outlet line 12 to the capillary 3 terminate, and a second chamber 13, which is connected to a bulb 15 via a capillary line 14. This bulb contains a liquid 16, for example the same liquid as the refrigerant in the refrigerating circuit, whose liquid pressure depends on the ambient temperature. The plunger 8 is provided with shutoff means 17 for closing or opening the outlet opening 18 to the outlet line 12.

When the temperature-sensitive control element 6 signals a temperature higher than a specific value the electric motor for the compressor will be switched on. The refrigerant liquid/gas circulates in the circuit in known manner. The valve construction is such that the force acting on one side of the plunger 8 as a result of the condenser pressure obtaining in the first chamber 10 is larger than the force acting on the other side of the plunger as a result of the pressure which obtains in the second chamber 13 and which depends on the ambient temperature. As a result of this, the shut-off means 17 is urged away from the outlet opening and the refrigerant gas can flow normally from the condenser 2 to the capillary 3.

When the temperature-sensitive control element 6 detects a temperature below a specific value the electric motor for the compressor will be switched off. The pressure in the refrigerating circuit and hence that in the first chamber 10 will decrease. Since the pressure in the second chamber 13 remains at the same level, the shut-off means 17 of the plunger 8 will close the outlet opening 18 if the condenser pressure is equal to the pressure in the second chamber. Shutting off is effected rapidly once the condenser pressure exhibits a rapidly decreasing tendency. This means that in operation the pressure in the second chamber need only be slightly lower than the condenser pressure. This can be achieved by selecting for the medium in the bulb 15 and in the chamber 13 another medium than in the refrigerating system. For example, it is possible to utilise a refrigerating circuit operating with $CCl_2F_2$ (trade name Freon R12) and to use the refrigerant $C_2ClF_{15}$ (trade name Freon R115) in the bulb circuit.

The precise adaptation of the two refrigerants to one another depends greatly on the prevailing condenser pressure, i.e. on the design of the refrigerating circuit. The balance between the two obtaining forces can be fine-adjusted by means of a spring 19.

If the bulb/chamber combination is filled with the same medium as the refrigerating system the spring is needed to provide said additional force, so that the value is already closed at a distinctly higher pressure than the pressure corresponding to ambient temperature. If this is not the case too much liquid refrigerant will be conveyed from the condenser to the evaporator.

By arranging the bulb 15 at a location which is at the ambient temperature (detectable by the condenser), the influence of the ambient temperature on the condenser pressure is compensated for automatically. Moreover, the system operates in such a way that in the event of a leakage in the bulb circuit the valve (even at low ambient temperatures) will fail to close and the system will operate normally, i.e. in the conventional manner with pressure equalization.

What is claimed is:

1. A refrigerating system comprising a reciprocating compressor, a condenser, an expansion means, an evaporator, a temperature-sensitive control element for on/off control of the compressor, and a refrigerant-pressure-dependent valve for shutting off the flow of refrigerant between the condenser and the evaporator when the compressor is turned off and for allowing the flow of refrigerant between the condenser and the evaporator when the compressor is turned on, which valve comprises a pressure-sensitive means comprising shut-off means movable under the influence of the condenser outlet pressure which prevails at one side of the pressure-sensitive means, wherein the refrigerating system comprises a bulb arranged at a location which is exposed to ambient temperature variations and containing a liquid the saturation pressure of which depends on the ambient temperature, said bulb being connected to the other side of the pressure-sensitive means by a capillary line whereby pressure exerted on said pressure-sensitive means by said saturation pressure relative to pressure exerted on said means by said condenser outlet pressure is effective to shut off the flow of refrigerant between the condenser and evaporator when the compressor is turned off.

2. A refrigeration system as claimed in claim 1, wherein the valve comprises a spring whose spring bias exerts a force on the pressure sensitive element to assist the action of the saturation pressure on the pressure-sensitive means.

3. A refrigerating system as claimed in claim 1 wherein said valve is provided with a housing comprising a movable plunger dividing said housing into a first chamber in which an inlet line from the condenser and an outlet line to a capillary tube terminate and a second chamber which is connected to the bulb by a capillary line.

4. A refrigerating system as claimed in claim 3 in which the bulb contains a liquid that is the same as the refrigerant

5. A refrigerating system as claimed in claim 4 in which a balance between the condenser pressure and the saturated pressure is adjusted by means of a spring which exerts a force on the pressure sensitive element to assist the action of the saturation pressure on the pressure-sensitive means.

6. A refrigerating system comprising a reciprocating compressor, a condenser, an expansion means, an evaporator, a temperature-sensitive control element for on/off control of the compressor, and a refrigerant pressure-dependent valve for shutting off the flow of refrigerant between the condenser and the evaporator when the compressor is turned off which valve comprises a housing having a movable plunger provided with shut off means for opening and closing the outlet line to the expansion means, said plunger being suspended from a pressure-sensitive element and dividing the housing into a first chamber in which an inlet line from the condenser and an outlet line to the expansion means terminate and a second chamber connected to a bulb via a capillary line, the bulb being arranged at a location which is exposed to ambient temperature and containing a liquid the saturation pressure of which depends on the ambient temperature; wherein the shut-off means is urged away from the outlet opening when the force acting on the plunger at the first chamber is larger than the force acting on the plunger at the second chamber and the shut-off means closes the outlet opening when the said force acting on said first chamber is equal to or less than the force acting on said second chamber.

7. A refrigerating system as claimed in claim 6 wherein the bulb contains a liquid that is the same as the refrigerant.

8. A refrigerating system as claimed in claim 7 wherein a balance between the condenser pressure and the saturated pressure is adjusted by means of a spring which exerts a force on the pressure-sensitive element to assist the action of the saturation pressure on the pressure-sensitive means.

* * * * *